US008677705B2

(12) United States Patent
Dyson

(10) Patent No.: US 8,677,705 B2
(45) Date of Patent: Mar. 25, 2014

(54) GRAIN BIN SUPPORT STRUCTURE FOR CONDITIONING SYSTEM AND METHOD OF INSTALLING SAME

(76) Inventor: Jeffrey D. Dyson, Wabash, IN (US)

( * ) Notice: Subject to any disclaimer, the term of this patent is extended or adjusted under 35 U.S.C. 154(b) by 170 days.

(21) Appl. No.: 13/363,950

(22) Filed: Feb. 1, 2012

(65) Prior Publication Data

US 2012/0198782 A1 Aug. 9, 2012

Related U.S. Application Data

(60) Provisional application No. 61/439,410, filed on Feb. 4, 2011.

(51) Int. Cl.
*E04G 11/04* (2006.01)

(52) U.S. Cl.
USPC ..... 52/247; 52/245; 52/295; 52/292; 52/192; 52/197; 34/169

(58) Field of Classification Search
USPC ..... 52/192, 194, 197, 73, 245, 247, 292, 52/295, 296, 745.01; 220/638, 636, 628; 248/216.1, 231.91; 34/166, 167, 169; 126/252, 256, 258, 260; 454/174, 182
See application file for complete search history.

(56) References Cited

U.S. PATENT DOCUMENTS

| | | | | | |
|---|---|---|---|---|---|
| 538,237 | A | * | 4/1895 | Cook | 432/98 |
| 2,818,009 | A | * | 12/1957 | Steffen | 454/180 |
| 2,852,110 | A | * | 9/1958 | Dueringer | 52/246 |
| 2,873,505 | A | * | 2/1959 | Sheldon | 264/34 |
| 3,685,232 | A | * | 8/1972 | Steffen | 52/741.15 |
| 4,037,527 | A | * | 7/1977 | Steffen | 454/182 |
| 4,306,490 | A | * | 12/1981 | Kallestad et al. | 454/182 |
| RE31,368 | E | * | 9/1983 | Trumper | 52/302.2 |
| 4,424,634 | A | * | 1/1984 | Westelaken | 34/167 |
| 5,468,122 | A | * | 11/1995 | Van Fossen | 414/808 |
| 5,551,167 | A | * | 9/1996 | van Fossen | 34/491 |
| 6,017,180 | A | * | 1/2000 | Wilham | 414/305 |

* cited by examiner

*Primary Examiner* — Robert Canfield
*Assistant Examiner* — Matthew Gitlin
(74) *Attorney, Agent, or Firm* — Barnes & Thornburg LLP

(57) ABSTRACT

A support structure for conditioning systems, such as blowers and/or heaters, that are used with grain bins and a method for installing same. To aid in aligning the conditioning system and grain bin, one embodiment uses beams that are partially embedded in the grain bin's concrete foundation and extend from the foundation. By linking the grain bin's foundation with the support structure that carries the conditioning system, the grain bin and support structure are aligned with respect to each other. Any movement of the grain bin's foundation will cause concomitant movement of the support base to prevent misalignment between the grain bin and conditioning system as time goes on.

19 Claims, 9 Drawing Sheets

GRAIN BIN SUPPORT STRUCTURE FOR CONDITIONING SYSTEM AND METHOD OF INSTALLING SAME

RELATED APPLICATIONS

This application claims the benefit of U.S. Provisional Application Ser. No. 61/439,410 filed Feb. 4, 2011, for a "Grain Bin Support Structure for Conditioning System and Method of Installing Same," which is hereby incorporated by reference in its entirety.

TECHNICAL FIELD

This invention relates generally to grain bins; in particular, this invention relates to a structure for supporting a conditioning system, such as a heater and/or fan, with respect to a grain bin in proper alignment.

BACKGROUND

Harvested crops, such as grain, are often stored in grain bins. FIG. 1 shows a side view of an example grain bin 10 in the prior art. As is typical, the bin 10 has a concrete foundation 12 on which the bin wall 14 is supported. The bin 10 may have a perforated floor 16 that suspends the grain above the foundation 12. A conditioning system 18, such as a heater and/or fan, may be provided to maintain a target condition within the bin to increase grain quality, such as a target moisture or humidity. The conditioning system 18 is often attached to the bin wall 14, typically below the floor 16, using a transition 20. The transition 20 directs heat/air through a hole in the bin wall 14 below the floor 16, which permeates through the perforations to the grain.

One issue that arises is proper support and alignment of the conditioning system 18 with respect to the grain bin 10. Often, the conditioning system 18 is supported by a concrete pad 22. However, it is difficult to obtain a proper alignment of the concrete pad 22 with respect to the grain bin and so the conditioning systems 18 are often misaligned. For example, the ground surrounding the grain bin 10 may not be level, which means the concrete pad and conditioning system 18 may not be level. FIGS. 1A, 1B, and 1C show various possible situations in which the concrete pad 22 and conditioning system 18 are misaligned with respect to the grain bin 10.

Therefore, there exists a need for a support structure that properly aligns grain bins with conditioning systems.

SUMMARY

This disclosure provides a support structure for conditioning systems, such as blowers and/or heaters, that are used with grain bins. In one embodiment, the difficulty in aligning the conditioning system and grain bin is solved by using beams that are partially embedded in the grain bin's concrete foundation and extend from the foundation. By linking the grain bin's foundation with the support base for the conditioning system, the grain bin and support base are aligned with respect to each other. Moreover, any movement of the grain bin's foundation will cause concomitant movement of the support base to prevent misalignment between the grain bin and conditioning system as time goes on.

In one aspect, the invention provides a grain bin with a concrete foundation. A perforated floor is suspended above the foundation and an annular side wall extends from the floor to define a storage compartment. A support structure is attached directly to the concrete foundation and extends radially therefrom. A conditioning system, such as a heater or blower, is carried on the support structure for conditioning material in the storage compartment. The support structure is configured to carry the conditioning system in a cantilevered fashion.

In another aspect, the invention provides a grain bin with a concrete foundation. A perforated floor is suspended above the foundation and an annular side wall extends from the floor to define a storage compartment. A support structure is provided with one or more elongated beams that are at least partially embedded in the concrete foundation. The beams extend from the concrete foundation to form a base section. A conditioning system is carried on the base section of the support structure for conditioning material in the storage compartment. The base section of the support structure is configured to suspend the conditioning system of the ground in a cantilevered fashion.

According to a further aspect, the invention provides a method for installing a conditioning system for a grain bin. The method includes the step of arranging a plurality of form segments to define an outer perimeter of a grain bin foundation. Typically, one or more beams extend through at least one of the form segments. Concrete is poured into a void defined by the form segments to form the grain bin foundation such that the one or more beams are at least partially embedded in the concrete and suspended above the ground. A conditioning system is placed on the one or more beams and connected to the grain bin using a transition.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF DRAWINGS

The present disclosure will be described hereafter with reference to the attached drawings which are given as non-limiting examples only, in which.

Figure 1A:
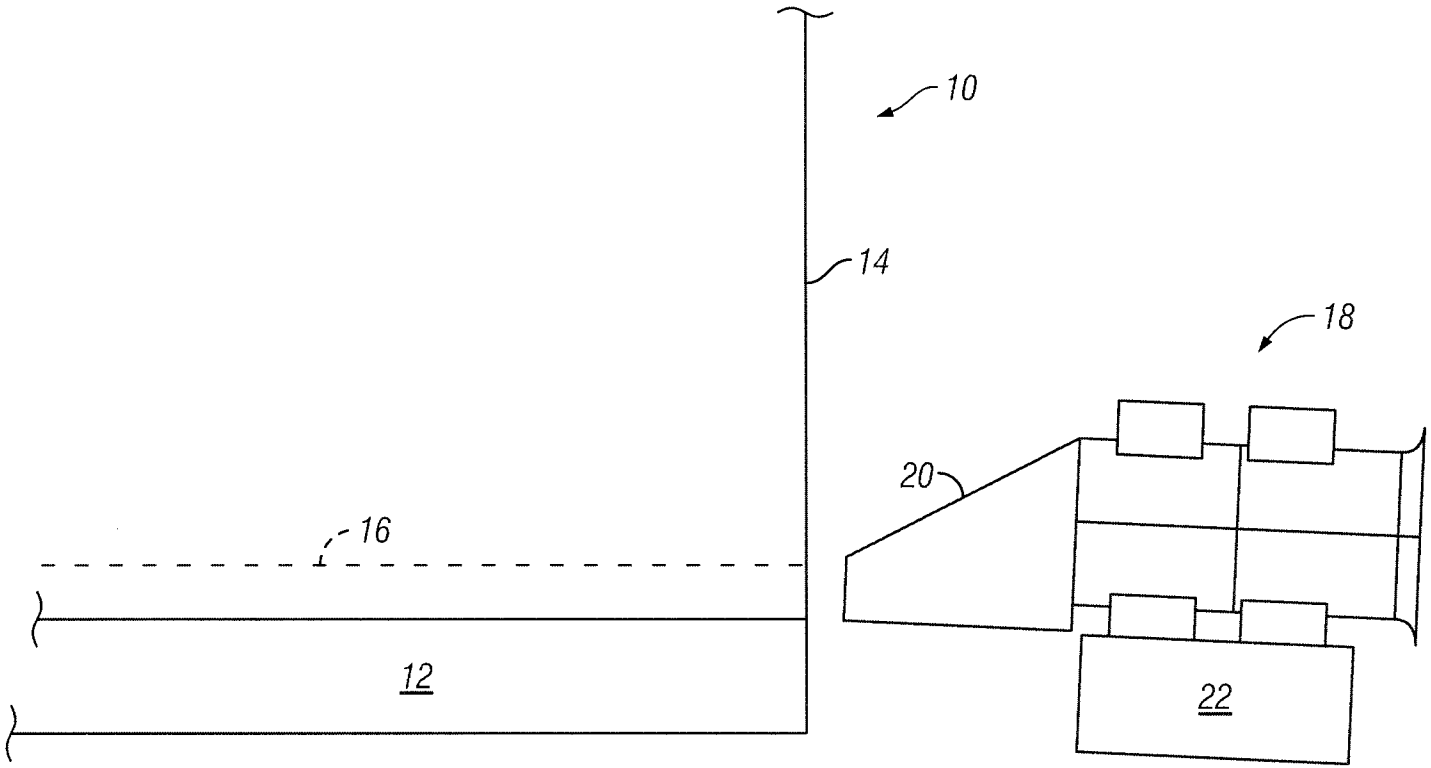
FIG. 1A (Prior Art)
FIG. 1A is a left side view of an example misaligned grain bin and conditioning system in the prior art.
Figure 1B:
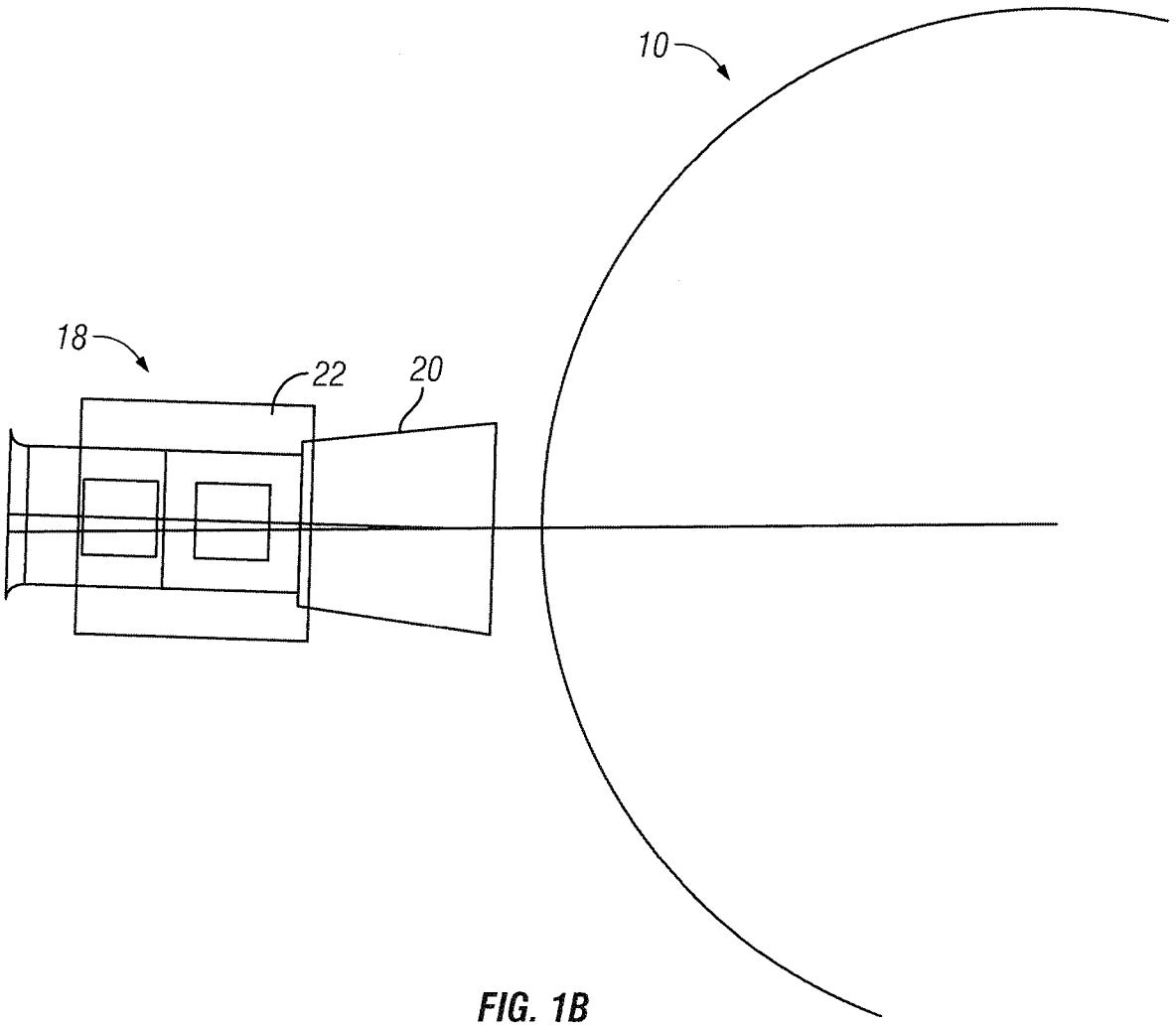
FIG. 1B (Prior Art)
FIG. 1B is a top view of an example misaligned grain bin and conditioning system in the prior art.
Figure 1C:
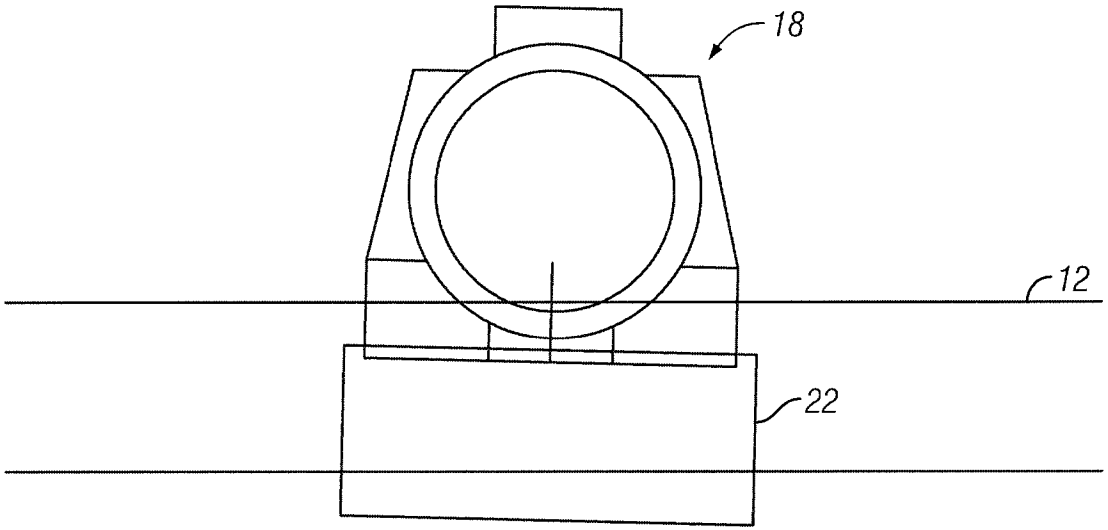
FIG. 1C (Prior Art)
FIG. 1C is a front view of an example misaligned grain bin and conditioning system in the prior art.

Corresponding reference characters indicate corresponding parts throughout the several views. The components in the figures are not necessarily to scale, emphasis instead being placed upon illustrating the principles of the invention. The exemplification set out herein illustrates embodiments of the invention, and such exemplification is not to be construed as limiting the scope of the invention in any manner.

DETAILED DESCRIPTION OF THE DRAWINGS

The present invention provides a support structure with proper alignment between a grain bin and a conditioning system, such as a heater and/or fan. In one embodiment, the support structure suspends the conditioning system off the ground using beams that are cantilevered from the grain bin's foundation. For example, one end of the beams may be embedded in the grain bin's concrete foundation and extend from the grain bin in a cantilevered manner to provide a support base for the conditioning system. By linking the grain bin's foundation with the support base for the conditioning system, the grain bin and support base are aligned with respect to each other. Moreover, any movement of the grain bin's foundation will cause concomitant movement of the support base to prevent misalignment between the grain bin and conditioning system as time goes on.

FIGS. 2-5 show an example support structure 100 according to an embodiment of the present invention. In the example shown, the support structure 100 includes a base section with a first beam 102 and a second beam 104. In one embodiment, the beams 102, 104 may be steel I-beams. One skilled in the art should appreciate that other types of beams, materials and configurations could be used that would support the conditioning system 18 by cantilevering from the grain bin's foundation. As shown, the first beam 102 and the second beam 104 are approximately parallel with respect to each other and are at approximately the same height to provide a level surface to support the conditioning system 18. One skilled in the art should appreciate that the base section may include additional beams and/or other configurations of beams that provide a level and aligned support surface for the conditioning system 18.

In this example, the first beam 102 and the second beam 104 have an embedded end 106 and an extended end 108. The embedded end 106 of the base section is embedded in the grain bin's concrete foundation during installation, which fixes its position. The extended end 108 extends from the grain bin's foundation in a cantilevered manner. On the embedded end 106, in the example shown, the beams 102, 104 have aligned holes 110 through which transverse bars 112 (FIG. 9) can be received to provide increased structural support in the concrete foundation.

As shown, the support structure 100 includes one or more form segments 114 that would be used during installation with other form segments to form the outside perimeter of the grain bin's concrete foundation. At least a portion of form segment 114 includes openings through which the beams 102, 104 extend. Preferably, the openings are dimensioned and/or configured to prevent transverse or angular movement of the beams 102, 104 during the installation of the grain bin's foundation. In this example, the form segment 114 includes holes 110 that may receive fasteners for securing adjacent form segments 114 together into a substantially continuous and uninterrupted surface for the outer perimeter of the grain bin's foundation. Typically, the form segments 114 are arcuate in shape so that the form segments 114 form an approximately circular foundation for the grain bin. In this example, the form segment 114 includes extensions 116 with slots dimensioned to receive rods 118 that are inserted into the ground during installation to prevent movement of the form segment 114. In this example, a pin 120 is provided that frictionally engages the rods to fix the position of the rods 118 with respect to the extensions 116. Once the grain bin's concrete foundation has been installed, the form segments 114 and rods 118 can be removed. The form segments could be discarded or reused during another installation.

Figure 2:
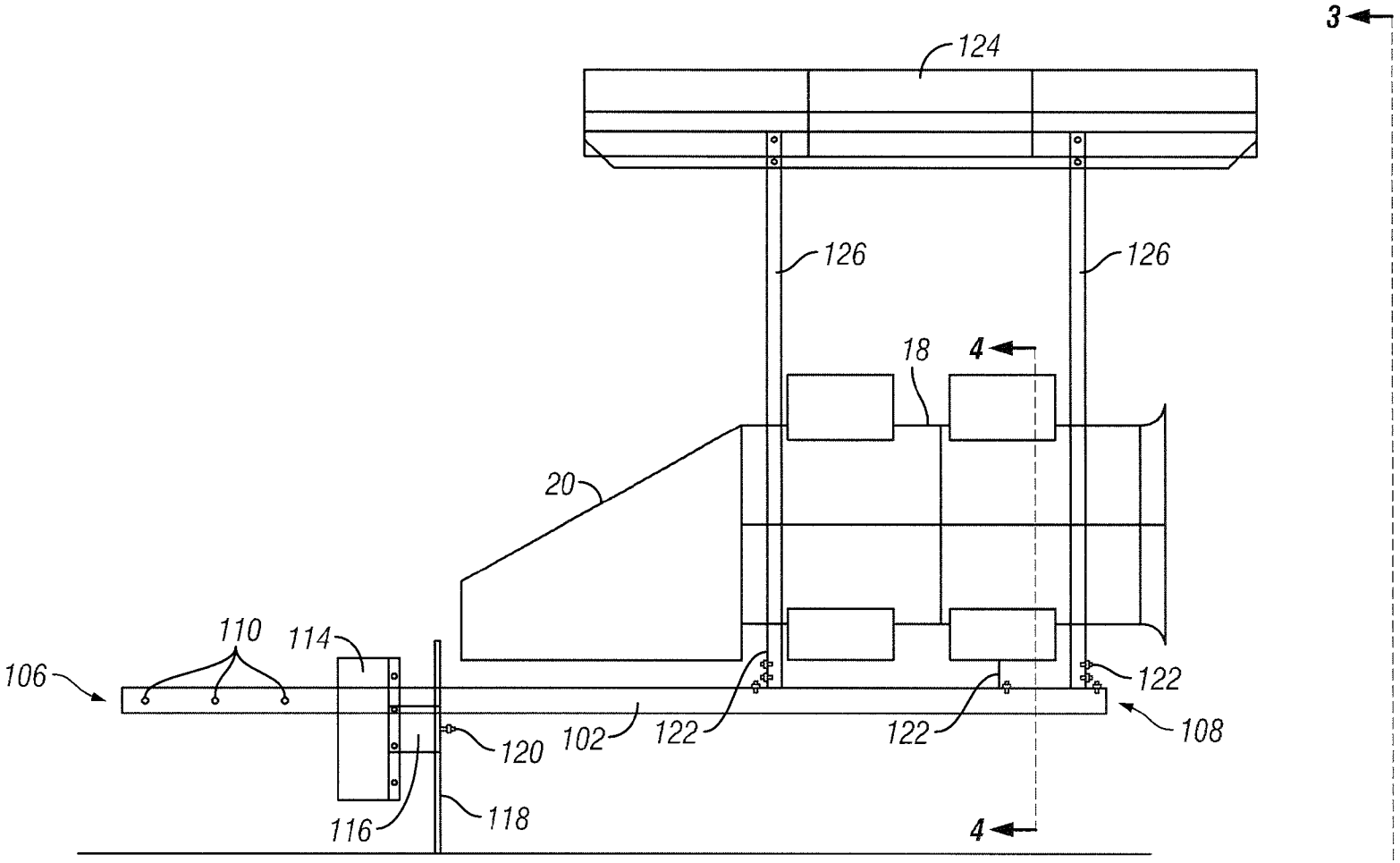
FIG. 2 is a left side view of an example support structure according to an embodiment of the present invention.
Figure 4:
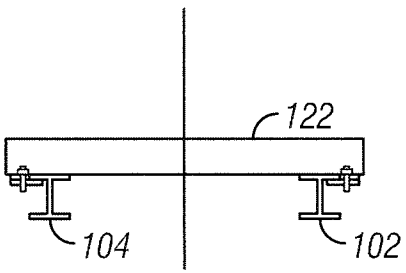
FIG. 4 is a cross-sectional view of the example support structure of FIG. 2 along line 4-4.
Figure 3:
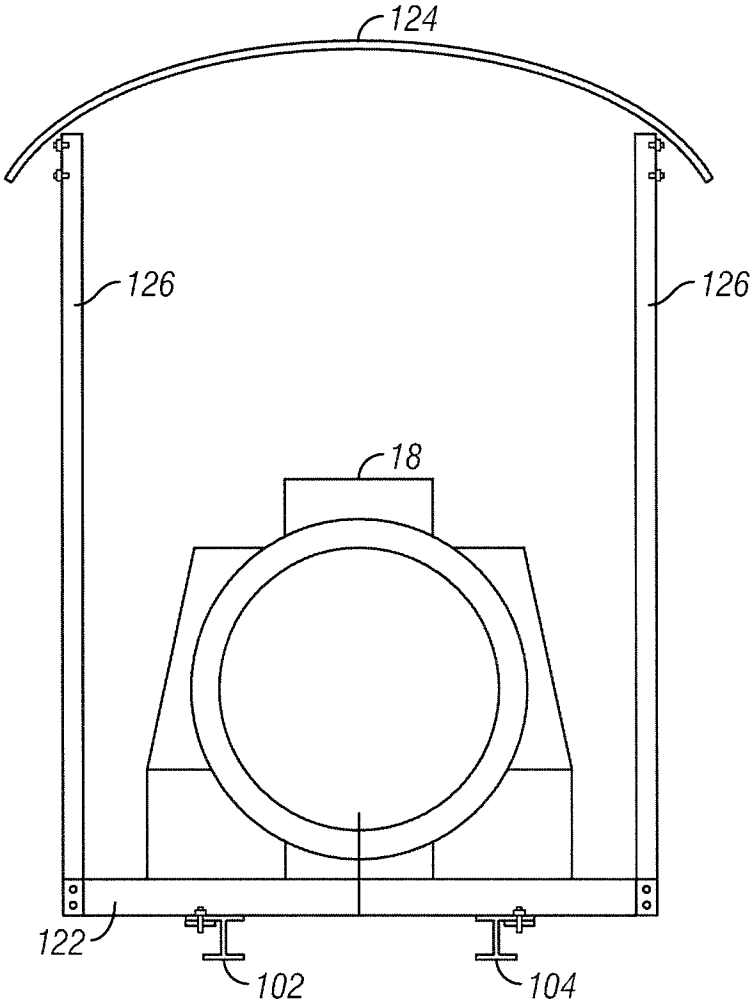
FIG. 3 is a cross-sectional view of the example support structure of FIG. 2 along line 3-3.
Figure 5:
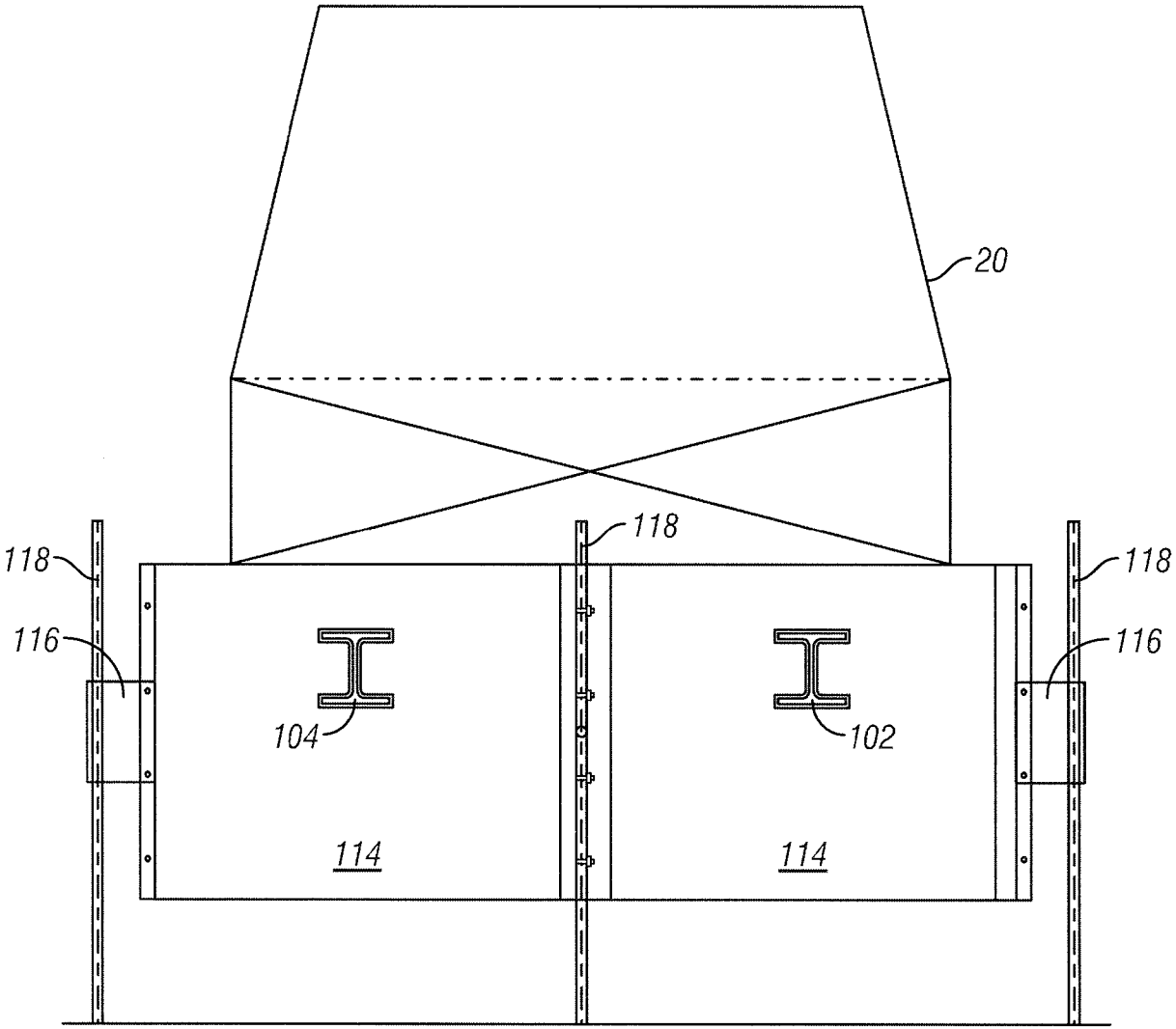
FIG. 5 is a front view of the example support structure shown in FIG. 2 without the roof section.
Figure 6:
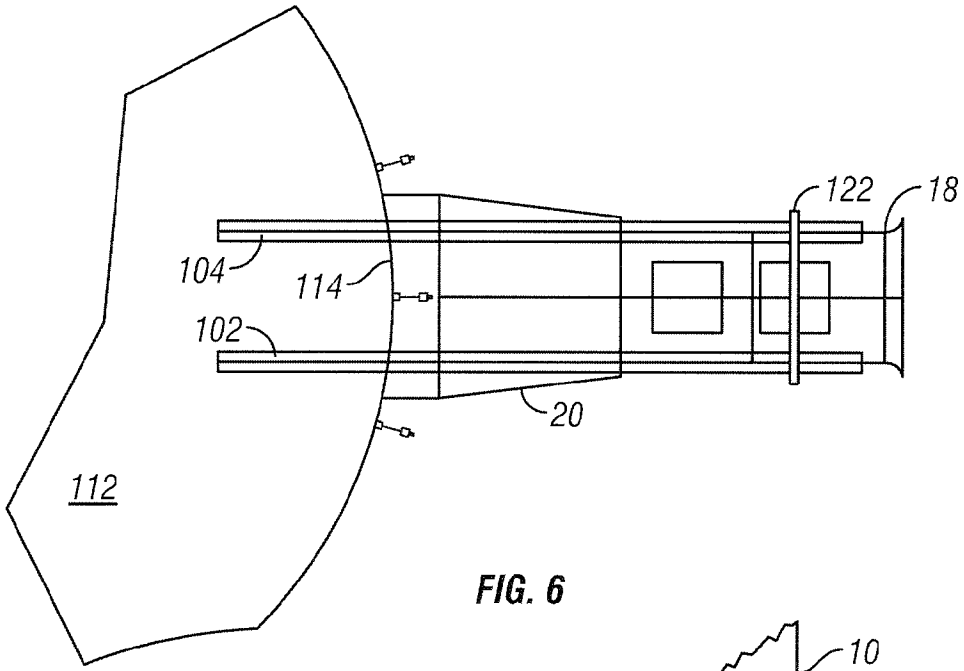
FIG. 6 is a top view of the example support structure shown in FIG. 2.

In this example, the base section includes transverse beams 122 that extend between the first beam 102 and second beam 104 and on which the conditioning system 18 may be supported. In one embodiment, the transverse beams 122 are movable along a longitudinal axis of the beams 102, 104 to accommodate different sizes of conditioning systems 18. For example, the transverse beams 122 could be arranged on the beams 102, 104 to accommodate a particular size of conditioning system and then coupled to the beams 102, 104. As shown in FIG. 2, an optional roof section 124 extends above the conditioning system 18 to provide some shelter from the elements. Although the roof section 124 shown has an arcuate shape, it should be appreciated by one skilled in the art that other shapes could be provided for the roof section 124. In this example, vertical beams 126 have a first end attached to the roof section 124 and a second end attached to transverse beams 122, which connect with beams 102, 104 to support the roof section 124.

Figure 7:
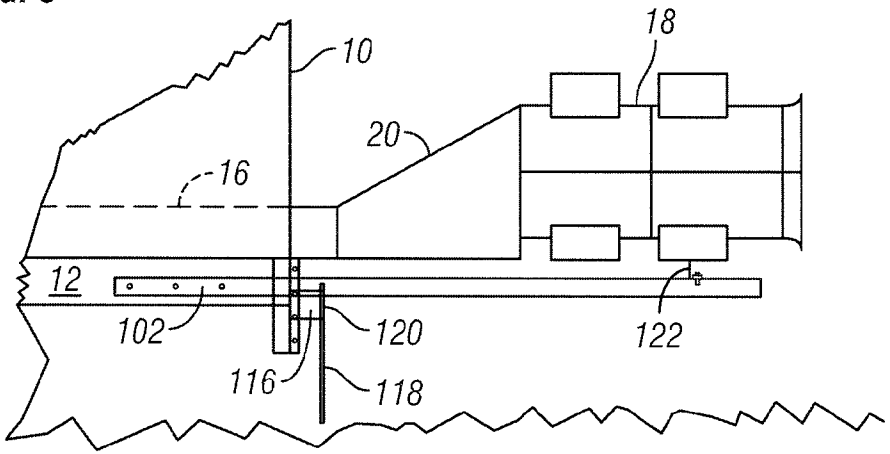
FIG. 7 is a left side view of the example support structure shown in FIG. 2 with the embedded end of the base section embedded in the grain bin foundation.
Figure 8:
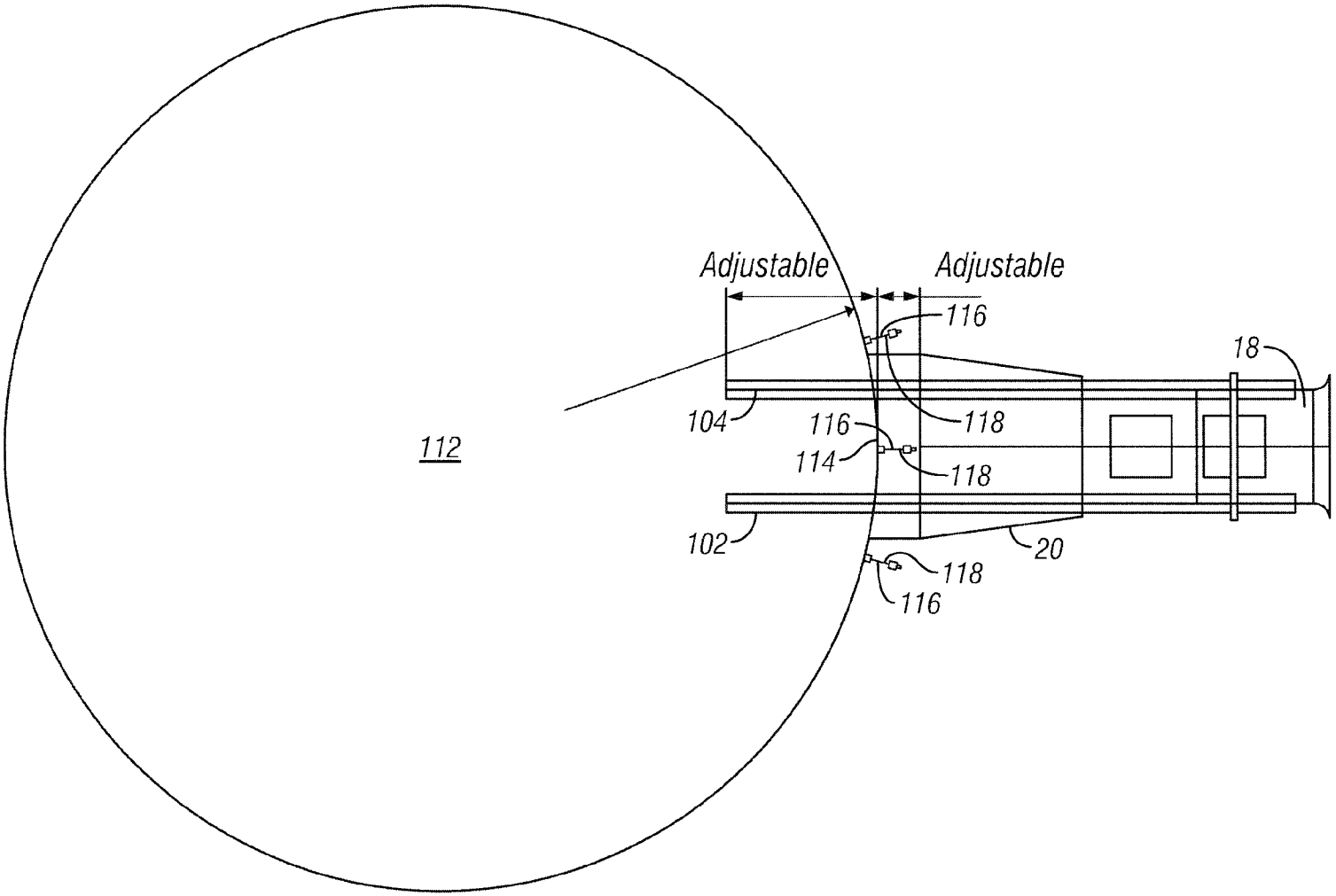
FIG. 8 is a top view of the example support structure shown in FIG. 2 showing an example foundation for the grain bin.
Figure 9:
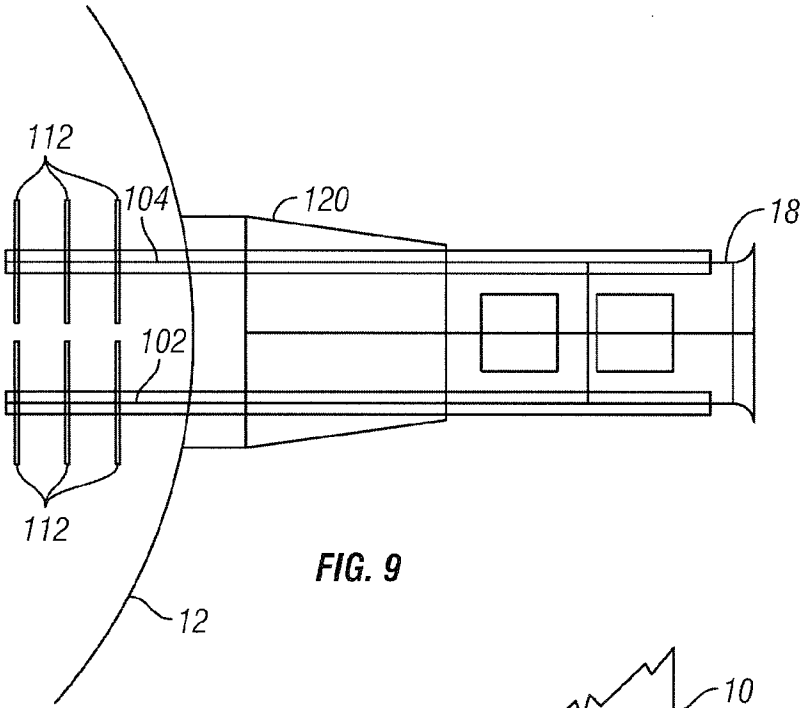
FIG. 9 is a top view of the support structure shown in FIG. 2.
Figure 10:
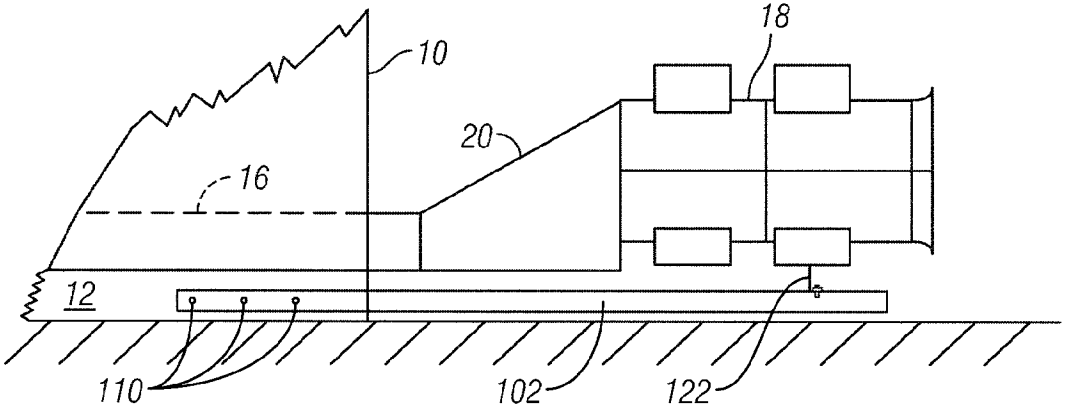
FIG. 10 is a left side view of the example support structure shown in FIG. 2.

Installation of the support structure 100 with regard to a grain bin's foundation will be discussed with reference to FIGS. 6-10. In one embodiment, the installation starts by determining the center point of the grain bin's foundation and driving a stake into the ground at that location. A string or the like is attached to the stake and extended to a position beyond the location of the conditioning system. The string defines an axis that is approximately perpendicular to an axis that is tangent to the grain bin's foundation. The support structure is positioned with respect to the string so that it bisects the beams 102, 104, which means that the beams 102, 104 are approximately perpendicular to the tangent axis of the foundation. When the beams 102, 104 are properly aligned, the form segments are positioned according to the desired diameter of the grain bin's foundation. The rods 118 may then be driven into the ground, such as shown in FIG. 7. The bars 112 may be placed into the holes in the beams 102, 104, as shown in FIG. 9. The concrete may be poured to form the grain bin's foundation. When the concrete has set up, the beams 102, 104 are cantilevered from the concrete foundation of the grain bin 10. At this point, the conditioning system 18 may be placed on the support structure 10, such as shown in FIG. 10, which is suspended above the ground.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A grain bin comprising:

a concrete foundation;

a perforated floor suspended above the foundation;

an annular side wall extending from the floor to define a storage compartment;

a support structure attached directly to the concrete foundation and extending radially therefrom, a conditioning system carried on the support structure for conditioning material in the storage compartment, wherein the conditioning system is in fluid communication with the storage compartment; and wherein the support structure is configured to carry the conditioning system in a cantilevered fashion wherein the support structure includes one or more beams at least partially embedded in the concrete foundation and extending therefrom.

2. The grain bin as recited in claim 1, wherein the beams are formed from steel.

3. The grain bin as recited in claim 2, wherein the beams are I-beams.

4. The grain bin as recited in claim 1, wherein the support structure includes a first beam and a second beam extending from the concrete foundation to define a base section on which the conditioning system is carried.

5. The grain bin as recited in claim 4, wherein the first beam and the second beam have a first end embedded in the concrete foundation and a second end extending from the concrete foundation.

6. The grain bin as recited in claim 5, wherein the first beam and the second beam are substantially parallel with respect to each other.

7. The grain bin as recited in claim 6, wherein the first beam and the second beam are aligned to provide a substantially level surface on which the conditioning system is carried.

8. The grain bin as recited in claim 5, wherein the first beam and the second beam have aligned holes through which a transverse bar extends.

9. The grain bin as recited in claim 5, wherein the support structure includes a roof suspended above the conditioning system using one or more vertically extending beams.

10. A grain bin comprising:

a concrete foundation;

a perforated floor suspended above the foundation;

an annular side wall extending from the floor to define a storage compartment;

a support structure with one or more elongated beams at least partially embedded in the concrete foundation, wherein the beams extend from the concrete foundation to form a base section;

a conditioning system carried on the base section of the support structure for conditioning material in the storage compartment; and wherein the base section of the support structure is configured to suspend the conditioning system of the ground in a cantilevered fashion.

11. The grain bin of claim 10, wherein the beams extend substantially radially from the concrete foundation.

12. The grain bin as recited in claim 10, wherein the beams are formed from steel.

13. The grain bin as recited in claim 12, wherein the beams are I-beams.

14. The grain bin as recited in claim 10, wherein the support structure includes at least two beams that are substantially parallel with respect to each other.

15. The grain bin as recited in claim 14, wherein the beams have aligned holes through which a transverse bar extends.

16. The grain bin as recited in claim 10, wherein the support structure includes a roof suspended above the conditioning system using one or more vertically extending beams.

17. A method for installing a conditioning system for a grain bin, the method comprising the steps of:

arranging a plurality of form segments to define an outer perimeter of a grain bin foundation, wherein one or more beams extend through at least one of the form segments;

pouring concrete into a void defined by the form segments to form the grain bin foundation such that the one or more beams are at least partially embedded in the concrete and suspended above the ground;

placing a conditioning system on the one or more beams; and connecting the conditioning system to the grain bin using a transition.

18. The method of claim 17, wherein the beams are steel I-beams.

19. The method as recited in claim 17, wherein the beams extend radially from the grain bin foundation.

* * * * *